US006543172B1

(12) United States Patent
Armstrong

(10) Patent No.: US 6,543,172 B1
(45) Date of Patent: Apr. 8, 2003

(54) BUTTSTOCK ASSEMBLY WITH REMOVABLE AND SEALABLE STORAGE TUBES

(75) Inventor: David P. Armstrong, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/052,858

(22) Filed: Jan. 23, 2002

(51) Int. Cl.[7] ..... F41C 23/00
(52) U.S. Cl. ..... 42/71.01
(58) Field of Search ..... 42/71.01, 90, 72; 89/1.42

(56) References Cited

U.S. PATENT DOCUMENTS 746,859 A * 12/1903 Marble ..... 42/6
1,266,024 A * 5/1918 Kennedy ..... 42/71.01
1,489,677 A * 4/1924 Stampfli ..... 42/71.01
2,298,678 A * 10/1942 Chase ..... 42/71.01
2,667,005 A * 1/1954 Weis ..... 42/74
3,618,248 A * 11/1971 Into et al. ..... 42/71.01
4,512,101 A * 4/1985 Waterman, Jr. ..... 42/71.01
5,755,055 A * 5/1998 Thompson et al. ..... 42/71.01

* cited by examiner

*Primary Examiner*—Michael J. Carone
*Assistant Examiner*—M. Thomson
(74) *Attorney, Agent, or Firm*—James B. Bechtel, Esq.; Peter J. Van Bergen, Esq.

(57) ABSTRACT

A buttstock assembly has a buttstock that holds a plurality of removable and sealable tubes. The buttstock has a butt plate, an elongated body extending perpendicularly away from the butt plate, and a structural web coupled to the butt plate and elongated body. The elongated body defines a central cavity and an elongated cavity on either side thereof. Each tube is sealable and forms a sliding fit with one elongated cavity.

20 Claims, 3 Drawing Sheets

FIG.2
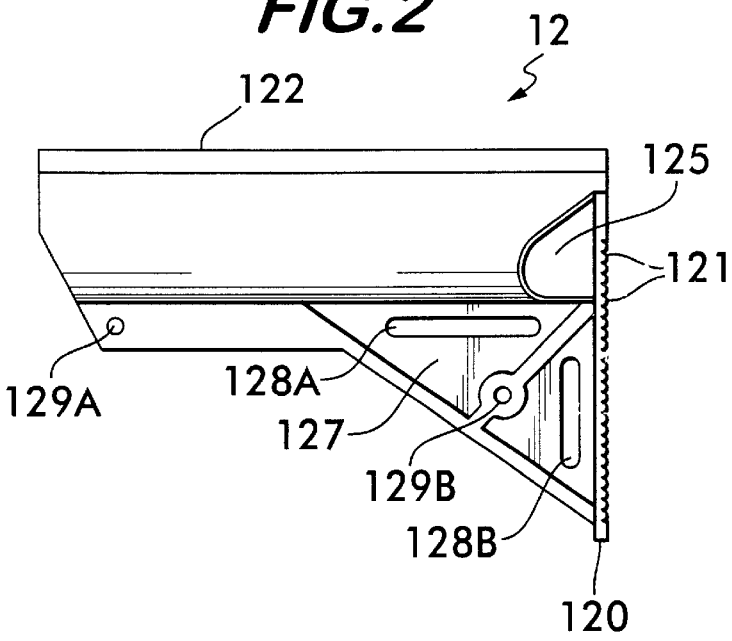
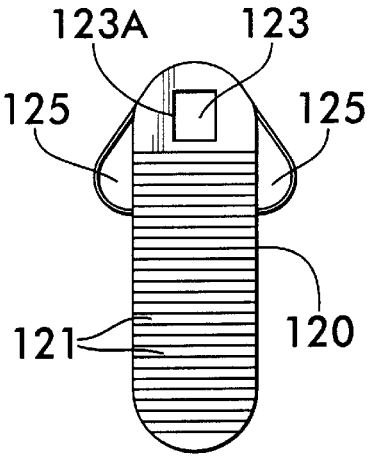
FIG.3
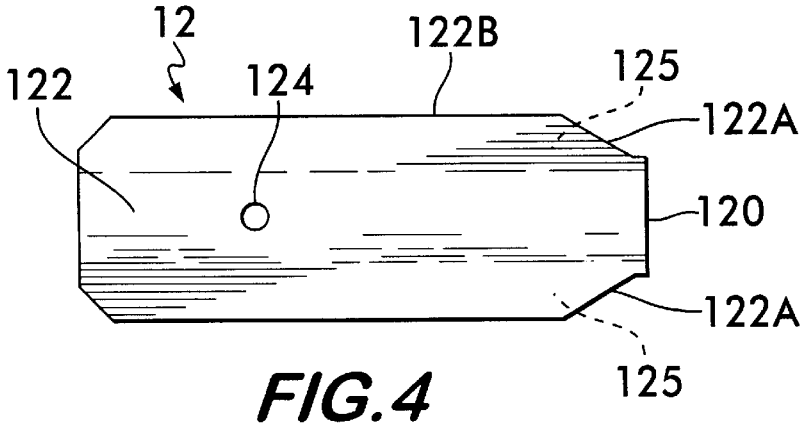
FIG.4
FIG.5
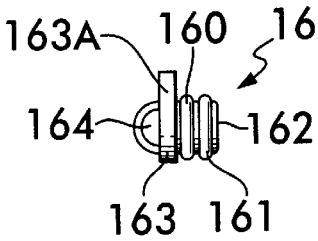

BUTTSTOCK ASSEMBLY WITH REMOVABLE AND SEALABLE STORAGE TUBES

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to buttstocks for attachment to firearms, and more particularly to a buttstock assembly that has removable storage tubes which can be sealed from the outside environment.

BACKGROUND OF THE INVENTION

For several military applications and/or operational groups, weapons may need to be collapsible for ease of transportation to a field venue, and then easily assembled in the field. For example, rifles are frequently designed to be collapsible. One typical portion of a collapsible rifle assembly is the buttstock that forms the aft-most part of the assembled rifle. In general, the buttstock must be ergonomic since the buttstock forms the interface with the user's shoulder area. Further, the buttstock can provide additional functionality such as a storage area since the buttstock does not generally contain any of the rifle's operating components. The storage area should provide a watertight and dirt-free environment. Still further, a good buttstock design should minimize the use of moving parts that can cause rattle noises, break, fall off, etc.

SUMMARY OF THE INVENTION

Accordingly, it is an object of the present invention to provide a buttstock assembly for a collapsible rifle.

Another object of the present invention is to provide a buttstock assembly having watertight and dirt-free storage areas.

Yet another object of the present invention is to provide an ergonomic buttstock assembly that is comfortable for a user over a range of shooting positions.

Other objects and advantages of the present invention will become more obvious hereinafter in the specification and drawings.

In accordance with the present invention, a buttstock assembly for attachment to a rifle includes a buttstock that lo holds a plurality of removable and sealable tubes. In its simplest embodiment, the buttstock has i) a butt plate, ii) an elongated body extending perpendicularly away from the butt plate, and iii) a structural web coupled to the butt plate and elongated body. The elongated body defines a central cavity for receiving therein a portion of the rifle and further defines an elongated cavity on either side of and parallel to the central cavity. Each tube is open on one end thereof and forms a sliding fit with one elongated cavity. A cap is provided for sealing the open end of the tube.

BRIEF DESCRIPTION OF THE DRAWINGS

FIG. 2 is an isolated side view of the buttstock portion of the assembly shown in FIG. 1;

FIG. 3 is an aft end view of the buttstock taken along line 3—3 of FIG. 1;

FIG. 4 is an isolated top view of the buttstock portion of the assembly taken along line 4—4 of FIG. 1;

FIG. 5 is an isolated side view of one of the tube's sealing caps; and

DETAILED DESCRIPTION OF THE INVENTION

Figure 1:
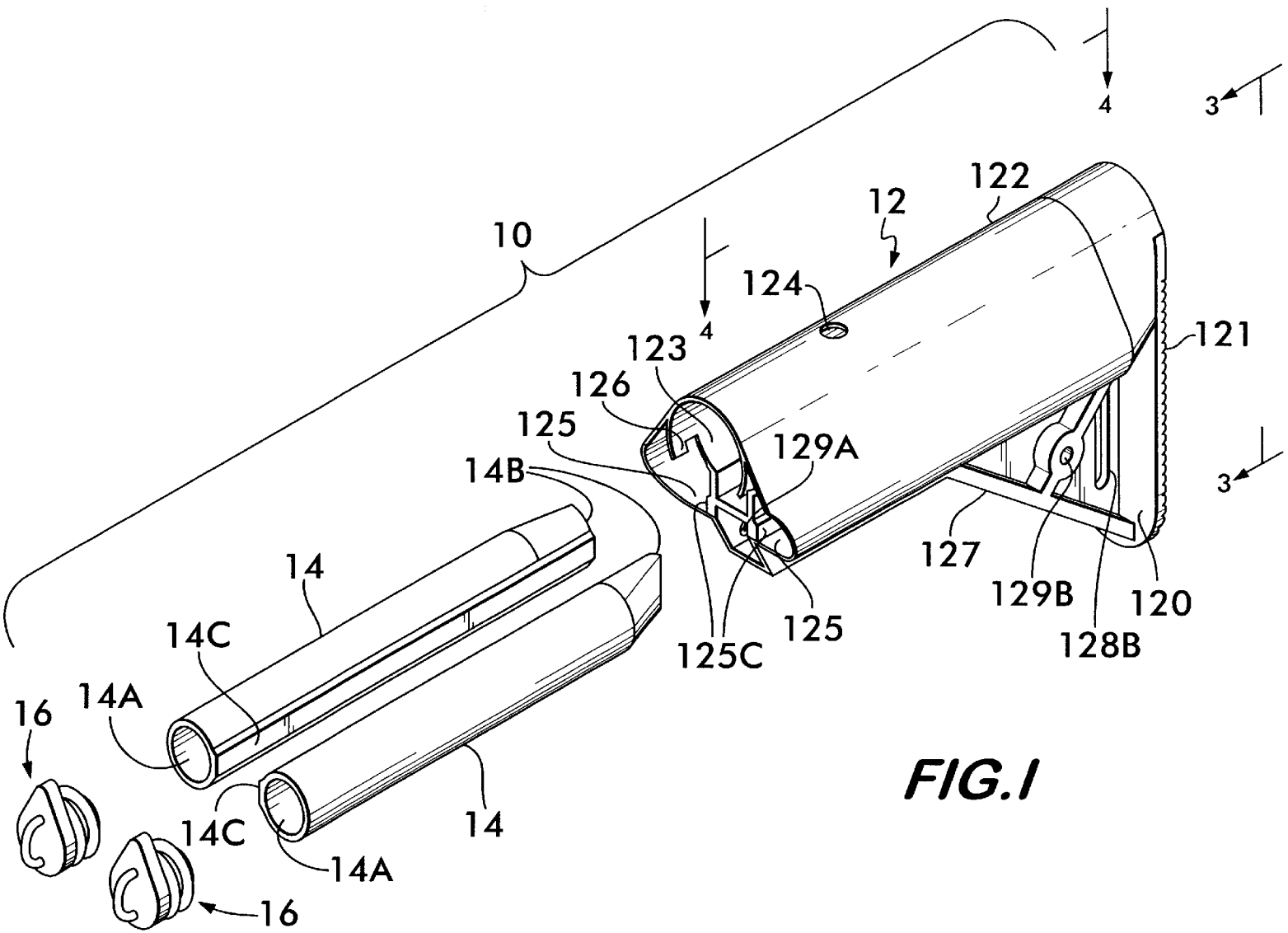
FIG. 1 is an exploded perspective view of the buttstock assembly in accordance with an embodiment of the present invention.

Referring now to the drawings, and more particularly to FIG. 1, an embodiment of the buttstock assembly in accordance lo with the present invention is illustrated and referenced generally by numeral 10. While buttstock assembly 10 will be described for its use with one of the U.S. Navy's M16 collapsible-stock carbine-type weapons (e.g., the M4A1 carbine), it is to be understood that the novel features thereof can be implemented in any buttstock assembly.

Buttstock assembly 10 has three separable components referred to herein as a buttstock 12, a storage tube 14 (two of which are shown and can be used), and a tube cap 16 for sealing each tube 14. In describing buttstock 12, additional and simultaneous reference will be made to FIGS. 2–4 where side, aft end and top views, respectively, of just buttstock 12 are shown.

Buttstock 12 has a butt plate 120 forming the interface with a user's shoulder or, as in a later described embodiment, forming an attachment plate for a recoil pad. In the illustrated embodiment, butt plate 120 has ridges 121 formed therein along its aft face (illustrated in FIG. 3) to minimize slippage when buttstock 12 is pressed against a user's shoulder.

Extending perpendicular to and forward from butt plate 120 is the buttstock's body 122 which defines a plurality of longitudinal cavities along its length. At its central portion, body 122 defines a central cavity 123 for attachment to the aft end of a weapon which could be the weapon's receiver or, as in the case the M16 carbines, a specially-provided tubular extension. Accordingly, the shape and size of cavity 123 will be dependent on the type of weapon to which the present invention will be joined. Typically, means are provided for securing the weapon to body 122. In terms of the M4A1 carbine rifle (not shown), its extension tube is inserted into central cavity 123. One of several holes in the extension tube is aligned with a through hole 124 that passes vertically through buttstock 12. The hole on the M4A1's extension tube that is aligned with hole 124 has a lockpin (not shown) passed therethrough to lock the rifle and buttstock 12 to one another. This method of attachment is well known in the art and is not a part of or a limiting feature of the present invention. The aft end of cavity 123 (visible in FIG. 3) can be open or partially open at 123A to facilitate the cleaning of cavity 123 should it become dirty.

Disposed on either side of and parallel to cavity 123 are tube cavities 125. Although not a requirement of the present invention, each of tube cavities 125 is identically sized and shaped to allow their usage with either of storage tubes 14. Each of tube cavities 125 is fully open or accessible at the forward end thereof (visible in FIG. 1) and can be partially open or accessible at the aft end thereof (visible in FIG. 3). By making the aft end of each tube cavity 125 accessible, cleaning of the cavities is facilitated as is the removal of storage tubes 14 as will be explained further below. A tab 126 can be formed at the fully open end of each cavity 125 to retain tube 14 and its cap 16 as will be explained further below.

As best seen in FIG. 4, the width of body 122 can be such that it increases gradually at either side thereof starting at butt plate 120. Specifically, the width of body 122 at its aft end is equal to that of butt plate 120 and then increases in a straightline angled fashion at 122A to a constant width at 122B. The ergonomic shaping of body 122 in this way allows the user to comfortably pivot buttstock 12 about butt plate 120 when butt plate 120 is pressed against a user's shoulder.

For structural rigidity of buttstock 12, butt plate 120 and body 122 are coupled to one another by a structural web 127. For a preferred construction of the present invention, buttstock 12 is molded from plastic (e.g., nylon) or cast in metal as a single unit so that web 127 is integral with butt plate 120 and body 122. In addition to its structural function, web 127 can be used to provide the means to couple a rifle sling thereto. For example, slots 128A and 128B can be cut through web 127 to provide the user with a variety of options for threading a rifle sling therethrough. Slots 128A and 128B are oriented perpendicular to one another with slot 128A being parallel and adjacent to body 122 and slot 128B being parallel to and adjacent butt plate 120. In addition to slots 128A and 128B, a plurality of circular holes 129A and 129B can be provided through web 127. Holes 129A and 129B accommodate a standard sling swivel stud (not shown) to which the end of a rifle sling can be attached.

Referring again to FIG. 1, each of tubes 14 is identically sized and shaped for use with either of tube cavities 125. Each tube 14 is open at one end 14A and is sealed at its other end 14B. The external size and shape of tube 14 is configured to slidingly engage the internal size and shape of tube cavity 125. The internal size and shape of tube 14 is configured to accommodate the items (not shown) to be stored therein. In the illustrated example, cavity 125 and tube 14 are keyed or indexed to one another to prevent relative rotation therebetween. More specifically, tube 14 is cylindrically shaped in its longitudinal exterior except for a flat portion 14C thereof that matches a flat portion 125C of cavity 125. The internal shape of tubes 14 can be cylindrical as shown. In the illustrated example, tubes 14 are made to fully fill cavity 125. Accordingly, since body 122 tapers in width at its aft end as shown in FIG. 4, end 14B of tube 14 must be correspondingly shaped to accommodate the tapering width of cavity 125 at its aft end. Note that this shaping of end 14B can be eliminated if the length of tube 14 is such that it will not extend into the decreasing width portion of body 122. Each tube 14 has its own sealing cap 16 which, when attached to tube 14, should make tube 14 a watertight storage compartment. While a variety of sealing systems can be used, FIG. 5 illustrates an embodiment of cap 16 which utilizes two O-rings 160 and 161 supported on a cylindrical stem 162 that extends from an end plate 163. A finger grip 164 extends from the opposite side of end plate 163. End plate 163 incorporates a tab 163A extending radially outward therefrom for reasons that will be explained below.

In operation, stem 162 of cap 16 is pressed into tube 14 until end plate 163 abuts open end 14A. While O-rings 160 and 161 insure a snug and sealing fit with tube 14, cap 16 can be rotated while in tube 14. Tube 14 is then aligned with one of cavities 125 so that flat portions 14C and 125C match up. Tube 14 is then slid fully into cavity 125 and cap 16 is rotated until tab 163A engages tab 126 of buttstock 12. The procedures is simply reversed to remove and un-cap tube 14. Note that if the aft end of tube cavities 125 is open, tubes 14 can be pushed therefrom if need be.

Figure 6:
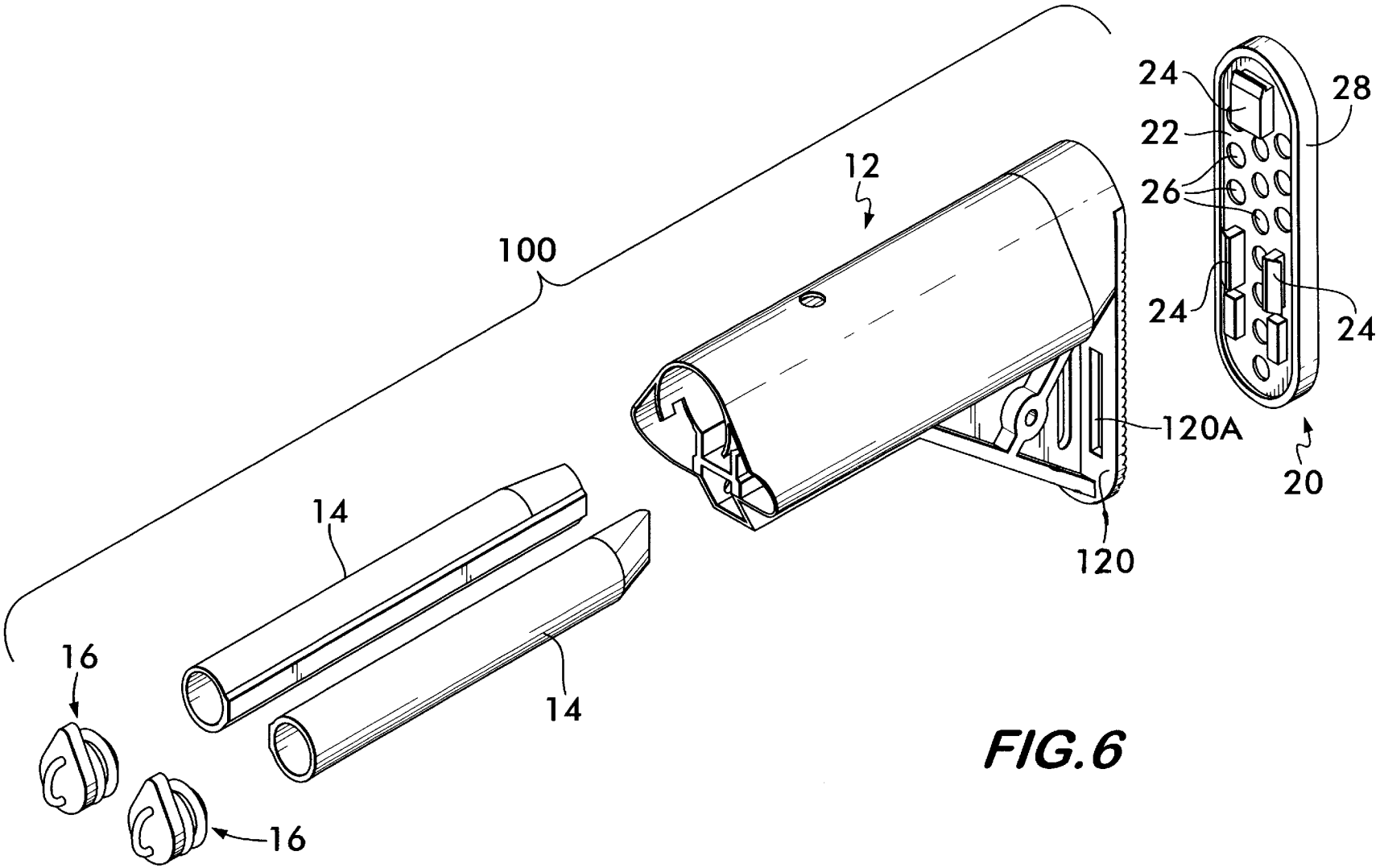
FIG. 6 is an exploded perspective view of the buttstock assembly in accordance with another embodiment of the present invention.

Referring now to FIG. 6, another embodiment of the present invention is shown and referenced generally by numeral 100. Assembly 100 adds a recoil pad 20 to the components described above for assembly 10. Accordingly, components common to each of assemblies 10 and 100 will be identified with the same reference numerals and will not be described again for assembly 100.

Recoil pad 20 is added to provide a more ergonomic and comfortable interface with a user's shoulder as opposed to the rigid interface provided by butt plate 120. In the illustrated embodiment, recoil pad 20 is constructed from a rigid (e.g., plastic) frame 22 having a plurality of attachment tabs 24 extending therefrom that will be used to attach recoil pad 20 to butt plate 120 without the use of any tools. Accordingly, mounting holes, such as 120A are provided in butt plate 120 to accommodate attachment tabs 24. The particular number and/or design of attachment tabs 26 and corresponding mounting holes are not limitations of the present invention. A plurality of holes 26 can be formed in frame 22. A rubber pad 28 is over-molded onto frame 22 with the rubber therefrom filling each of holes 26 during the over-mold process to keep rubber pad 28 on frame 22.

The advantages of the present invention are numerous. The butt stock assembly provides removable and interchangeable watertight storage tubes that are easily stored in and retained by the buttstock. Various ergonomic features (e.g., various sling position accommodation, the ability to pivot the butt stock comfortably on one's shoulder, etc.) will improve user satisfaction with the weapon to which the buttstock assembly is attached. The buttstock assembly further minimizes moving parts to reduce noise and breakage concerns.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A buttstock assembly for attachment to a rifle, comprising:

a buttstock having i) a butt plate, ii) an elongated body extending perpendicularly away from said butt plate, said elongated body defining a central cavity for receiving therein a portion of said rifle and further defining an elongated cavity on either side of and parallel to said central cavity, and iii) a structural web coupled to said butt plate and said elongated body;

a tube open on one end thereof and forming a sliding fit with each said elongated cavity; and a cap for sealing said one end of each said tube.

2. A buttstock assembly as in claim 1 further comprising a recoil pad coupled to said butt plate.

3. A buttstock assembly as in claim 1 wherein each said elongated cavity and an outer surface of each said tube are indexed to one another.

4. A buttstock assembly as in claim 1 wherein said cap is rotatable relative to said tube, said cap further comprising a tab extending radially outward therefrom wherein, when said tube is fitted in said elongated cavity with said cap sealing said one end of said tube, said cap can be rotated such that said tab engages a portion of said elongated body.

5. A buttstock assembly as in claim 1 wherein said web defines a first slotted hole parallel to said butt plate and a second slotted hole parallel to said elongated body.

6. A buttstock assembly as in claim 1 wherein said web defines a plurality of circular holes for receiving therein a sling swivel stud of a rifle sling assembly.

7. A buttstock assembly as in claim 1 wherein said buttstock is made from plastic.

8. A buttstock assembly as in claim 2 wherein said recoil pad comprises:

a rigid frame for attachment to said butt plate; and a rubber pad over-molded onto said frame.

9. A buttstock assembly for attachment to a rifle, comprising:

a molded buttstock having i) a butt plate, ii) an elongated body extending perpendicularly away from said butt plate, said elongated body being equal in width to said butt plate at said butt plate and gradually increasing in width at either side thereof to a fixed width a distance from said butt plate, said elongated body defining a central cavity for receiving therein a portion of said rifle and further defining an open-ended elongated cavity on either side of and parallel to said central cavity, and iii) a structural web coupled to said butt plate and said elongated body;

a tube open on one end thereof and forming a sliding fit with each said elongated cavity;

a cap for sealing said one end of each said tube; and a recoil pad attachable to said butt plate.

10. A buttstock assembly as in claim 9 wherein each said elongated cavity and an outer surface of each said tube are indexed to one another.

11. A buttstock assembly as in claim 9 wherein said cap is rotatable relative to said tube, said cap further comprising a tab extending radially outward therefrom wherein, when said tube is fitted in said elongated cavity with said cap sealing said one end of said tube, said cap can be rotated such that said tab engages a portion of said elongated body.

12. A buttstock assembly as in claim 9 wherein said web defines a first slotted hole parallel to and adjacent said butt plate and a second slotted hole parallel to and adjacent said elongated body.

13. A buttstock assembly as in claim 9 wherein said web defines a plurality of circular holes for receiving therein a sling swivel stud of a rifle sling assembly.

14. A buttstock assembly as in claim 9 wherein said buttstock is made from plastic.

15. A buttstock assembly as in claim 9 wherein said recoil pad comprises:

a rigid plastic frame having a plurality of tabs integral therewith and extending therefrom for engagement with said butt plate; and a rubber pad over-molded onto said plastic frame.

16. A buttstock assembly for attachment to a rifle, comprising:

a molded buttstock having i) a butt plate, ii) an elongated body extending perpendicularly away from said butt plate, said elongated body being equal in width to said butt plate at said butt plate and gradually increasing in width at either side thereof to a fixed width a distance from said butt plate, said elongated body defining a central cavity for receiving therein a portion of said rifle and further defining an elongated cavity on either side of and parallel to said central cavity with each said elongated cavity being fully accessible at a first end thereof and partially accessible at a second end thereof, and iii) a structural web coupled to said butt plate and said elongated body, said web defining a first slotted hole parallel to and adjacent said butt plate and a second slotted hole parallel to and adjacent said elongated body;

a tube open on one end thereof for longitudinal insertion into either said elongated cavity at said first end thereof, said tube forming a sliding fit with said elongated cavity;

a cap for sealing said one end of each said tube and for being rotatable relative to said tube, said cap further comprising a tab extending radially outward therefrom wherein, when said tube is fitted in said elongated cavity with said cap sealing said one end of said tube, said cap can be rotated such that said tab engages a portion of said elongated body to prevent longitudinal movement of said tube and said cap; and a recoil pad attachable to said butt plate.

17. A buttstock assembly as in claim 16 wherein each said elongated cavity and an outer surface of each said tube are indexed to one another to prevent relative rotational movement therebetween.

18. A buttstock assembly as in claim 16 wherein said web further defines a plurality of circular holes for receiving therein a sling swivel stud of a rifle sling assembly.

19. A buttstock assembly as in claim 16 wherein said buttstock is made from plastic.

20. A buttstock assembly as in claim 16 wherein said recoil pad comprises:

a rigid plastic frame having a plurality of tabs integral therewith and extending therefrom for engagement with said butt plate; and a rubber pad over-molded onto said plastic frame.

* * * * *